US011134769B2

(12) United States Patent
Larsen

(10) Patent No.: US 11,134,769 B2
(45) Date of Patent: Oct. 5, 2021

(54) LOUNGE CHAIR TOWEL THAT CONVERTS INTO BACKPACK

(71) Applicant: Ricci D. Larsen, Riverton, WY (US)

(72) Inventor: Ricci D. Larsen, Riverton, WY (US)

( * ) Notice: Subject to any disclaimer, the term of this patent is extended or adjusted under 35 U.S.C. 154(b) by 0 days.

(21) Appl. No.: 16/917,094

(22) Filed: Jun. 30, 2020

(65) Prior Publication Data

US 2020/0329853 A1 Oct. 22, 2020

Related U.S. Application Data

(63) Continuation of application No. 16/396,448, filed on Apr. 26, 2019, now Pat. No. 10,736,405.

(60) Provisional application No. 62/663,785, filed on Apr. 27, 2018.

(51) Int. Cl.

| | |
|---|---|
| ***A45F 4/02*** | (2006.01) |
| ***A47C 7/62*** | (2006.01) |
| ***A47C 31/11*** | (2006.01) |

(52) U.S. Cl.

CPC ..... *A45F 4/02* (2013.01); *A47C 7/622* (2018.08); *A47C 31/11* (2013.01); *A45F 2004/026* (2013.01)

(58) Field of Classification Search

CPC ..... A45F 4/02; A45F 2004/026; A47C 7/622; A47C 31/11

USPC ..... 297/129

See application file for complete search history.

(56) References Cited

U.S. PATENT DOCUMENTS

| | | | | |
|---|---|---|---|---|
| 4,738,545 | A | 4/1988 | Westgor | |
| 4,856,912 | A | 8/1989 | Damus et al. | |
| 5,346,308 | A | 9/1994 | Buhot et al. | |
| 5,441,789 | A | 8/1995 | Walker | |
| 5,454,643 | A | 10/1995 | Sullivan | |
| 5,482,374 | A | 10/1996 | Buhyoff | |
| 5,618,110 | A | 4/1997 | Sullivan | |
| 5,895,118 | A | 4/1999 | Hensley | |
| 6,536,638 | B1 * | 3/2003 | Gulmatico, III | A45C 7/0077 224/153 |
| 6,952,845 | B1 * | 10/2005 | Akkad | A45F 4/02 383/4 |
| 7,058,997 | B1 * | 6/2006 | Klinger | A45F 4/08 190/18 A |
| 8,490,238 | B2 | 7/2013 | Sohn | |
| 10,736,405 | B2 * | 8/2020 | Larsen | A45F 3/04 |
| 2004/0188482 | A1 | 9/2004 | Wilson et al. | |
| 2008/0281701 | A1 | 11/2008 | Scheiner | |
| 2014/0110442 | A1 | 4/2014 | Midgett | |

* cited by examiner

*Primary Examiner* — Mark R Wendell

(74) *Attorney, Agent, or Firm* — Duft & Bornsen, PC

(57) ABSTRACT

Lounge chair towel that converts into backpack. One embodiment is a lounge chair towel that includes a seat portion, a backrest portion, and a middle portion of material between the seat portion and the backrest portion. The middle portion includes a first sleeve on a back side of the lounge chair towel, a second sleeve on a front side of the lounge chair towel, and a middle sleeve disposed between the first sleeve and the second sleeve. The middle portion also includes a bag opening for a bag storage area formed by an interior of the backrest portion. The middle portion also includes one or more belt straps looped through the first sleeve and the second sleeve. The belt straps close the bag opening when pulled and forms two backpack straps to convert the lounge chair towel into the backpack.

20 Claims, 6 Drawing Sheets

LOUNGE CHAIR TOWEL THAT CONVERTS INTO BACKPACK

RELATED APPLICATIONS

This non-provisional application is a continuation of co-pending U.S. patent application Ser. No. 16/396,448 (filed on Apr. 26, 2019) titled, "LOUNGE CHAIR TOWEL THAT CONVERTS INTO BACKPACK," which claims priority to U.S. provisional application 62/663,785 (filed on Apr. 27, 2018), both of which are hereby incorporated by reference.

FIELD OF THE INVENTION

The invention relates to lounge chair towels, and in particular, to a lounge chair towel capable of carrying items.

BACKGROUND

Many variations of towels exist which incorporate straps for tying the towel or pouches for carrying items. There are also some towel designs that have a feature of optionally transforming the towel into a type of bag. However, there is still a need for a lounge chair towel capable of converting into a backpack having increased convenience and convertibility.

SUMMARY

Embodiments described herein provide for a lounge chair towel that converts into a backpack. The lounge chair towel is capable of securely attaching to a lounge chair and easily converting into a backpack that stows its own towel material and can hold a variety of additional personal items.

One embodiment is a lounge chair towel that converts into a backpack. The lounge chair towel includes a seat portion of towel material that corresponds with a seat of a lounge chair, a backrest portion of towel material that corresponds with a backrest of the lounge chair, and a middle portion of material between the seat portion and the backrest portion. The middle portion includes a first sleeve on a back side of the lounge chair towel, the first sleeve extending laterally along a width of the lounge chair towel and including first open lateral ends. The middle portion also includes a second sleeve on a front side of the lounge chair towel, the second sleeve extending laterally along the width of the lounge chair towel and including second open lateral ends. The middle portion further includes a middle sleeve disposed between the first sleeve and the second sleeve. The middle portion also includes a bag opening for a bag storage area formed by an interior of the backrest portion. The bag opening and the bag storage area are sized to slide over the backrest of the lounge chair. Furthermore, the middle portion includes one or more belt straps looped through the first sleeve and the second sleeve and at least two times around the middle sleeve. The belt straps are configured to tighten around the middle sleeve to close the bag opening by pulling the belt straps in opposite directions at the first open lateral ends and the second open lateral ends to form two backpack straps to convert the lounge chair towel into the backpack.

Another embodiment is a method of fabricating a lounge chair towel that converts into a backpack. The method includes providing a first piece of towel material having a continuous length, folding a first top portion of the first piece back onto the first piece to form a first sleeve with two layers of the towel material and open lateral ends, and folding a second top portion, including the first top portion and additional towel material below the first top portion, back onto the first piece to form a backrest portion of towel material that corresponds in size with a backrest of a lounge chair. A lower section of the backrest portion includes three layers of the towel material that form the first sleeve and a middle sleeve adjacent to the first sleeve. The method also includes joining, at corners of the lower section of the backrest portion, the three layers together to establish the first sleeve and the middle sleeve, and to form a bag opening for a bag storage area formed by an interior of the backrest portion. The bag opening and bag storage area are sized to slide over the backrest of the lounge chair. The method further includes attaching a second piece of material to a front side of the first piece of towel material. The second piece forms a second sleeve with open lateral ends, and the middle sleeve is disposed between the first sleeve and the second sleeve. The method also includes looping one or more belt straps through the first sleeve and the second sleeve. The belt straps are configured to tighten around the middle sleeve to close the bag opening by pulling the belt strap in opposite directions at the first open lateral ends and the second open lateral ends to form two backpack straps to convert the lounge chair towel into the backpack.

The features, functions, and advantages that have been discussed can be achieved independently in various embodiments or may be combined in yet other embodiments, further details of which can be seen with reference to the following description and drawings.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific example embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
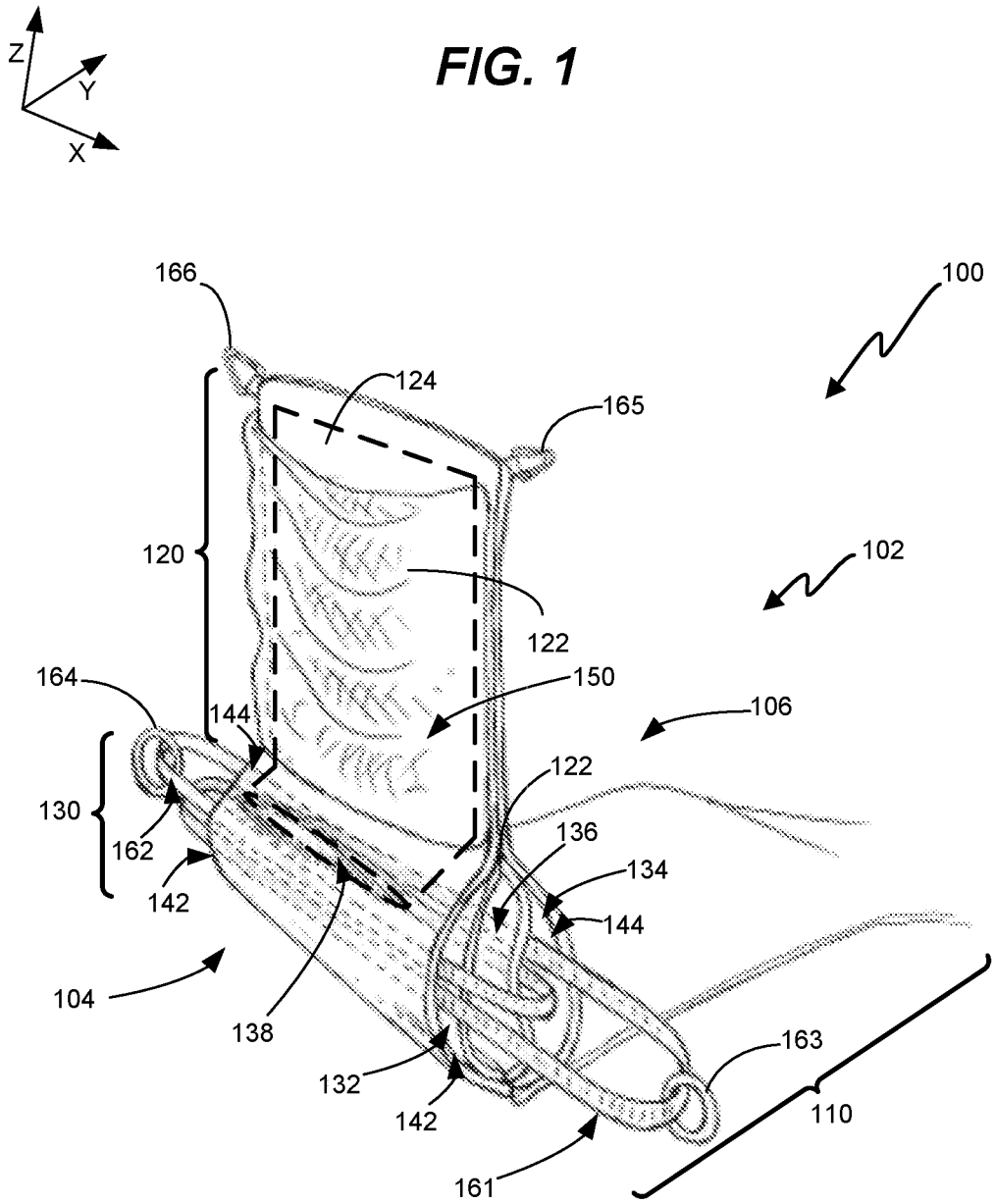
FIG. 1 is a perspective view of a lounge chair towel in an illustrative embodiment.

FIG. 1 is a perspective view of a lounge chair towel 100 in an illustrative embodiment. More particularly, FIG. 1 shows the lounge chair towel 100 deployed in a lounge configuration 102 to cover and attach with a lounge chair. The lounge chair may include any type of lounge chair commonly used at pools, beaches, and similar environments. As described in greater detail below, in addition to being well-suited for use with a lounge chair, the lounge chair towel 100 includes integrated features for conveniently transforming the towel material into a backpack with storage for its remaining towel material and additional personal items commonly used in pool environments, such as sunscreen, books, pool toys, etc.

The lounge chair towel 100 includes a seat portion 110 and a backrest portion 120. The seat portion 110 generally corresponds with a seat of the lounge chair, and the backrest portion 120 generally corresponds with a backrest of the lounge chair. Both the seat portion 110 and the backrest portion 120 include a towel material or fabric that is suitably absorbent for pool and beach environments, such as cotton, polyester, terrycloth, microfiber, bamboo etc.

The lounge chair towel 100 further includes a middle portion 130 that is between the seat portion 110 and the backrest portion 120. The middle portion 130 includes a first sleeve 132 on a back side 104 of the lounge chair towel 100, and a second sleeve 134 on a front side 106 of the lounge chair towel 100. Generally, the back side 104 of the lounge chair towel 100 faces the lounge chair, and the front side 106 of the lounge chair towel 100 faces the person sitting in the lounge chair. The middle portion 130 also includes a middle sleeve 136 disposed between the first sleeve 132 and the second sleeve 134.

The first sleeve 132 and second sleeve 134 each extend laterally (e.g., in the x-direction) along a width of the lounge chair towel 100 and have lateral open ends. That is, the first sleeve 132 has first open lateral ends 142 and the second sleeve 134 has second open lateral ends 144. Moreover, the middle portion 130 includes a bag opening 138 for a bag storage area 150 formed by an interior of the backrest portion 120, as indicated by the dashed lines in FIG. 1.

The middle portion 130 also includes one or more belt straps 161-162 that each loop through the first sleeve 132 and the second sleeve 134 around the middle sleeve 136. The belt straps 161-162 are configured to tighten around the middle sleeve 136 to close the bag opening 138 by pulling the belt straps 161-162 in opposite directions at the first open lateral ends 142 and the second open lateral ends 144. The belt straps 161-162 include respective fasteners 163-164 to detachably engage respective fastener rings 165-166 attached at or near a top end of the backrest portion 120. For example, the fastener rings 165-166 may by sewn at or near the top end corners of the backrest portion 120, as shown in FIG. 1. The fasteners 163-164 and/or the fastener rings 165-166 may include any suitable fastener combination including metal or plastic clasps, rings, clips, buckles, snaps, hooks, etc. The belt straps 161-162 may include any suitable strap material or fabric for wearing on a person's shoulders, including a flat strip of webbing made of nylon, polyester, polypropylene, etc. Alternatively, the belt straps 161-162 may include a rope or cord material.

In one embodiment, the belt straps 161-162 are separate straps offset vertically or longitudinally in the middle portion 130, as shown in FIG. 1. The belt straps 161-162 may laterally slide in their own sewn lateral channels of the first sleeve 132 and/or second sleeve 134 to prevent bunching of the belt straps 161-162. As the belt straps 161-162 are pulled in opposite directions, the opposite looped ends of each of the belt straps 161-162 squeeze the middle sleeve 136 to close the bag opening 138 while the pulled ends of each of the belt straps 161-162 extend to form backpack straps sized to be worn over a person's shoulders and convert the lounge chair towel 100 into the backpack, as described in further detail below.

In an alternative embodiment, the middle portion 130 may include a continuous belt that extends laterally (e.g., across the width of the lounge chair towel 100) through the middle portion 130 to form at least two belt loops around the middle sleeve 136. As the strap is pulled to engage the fasteners 163-164 with the fastener rings 165-166, at least one loop (e.g., a first loop or inner loop) of the belt strap contracts to squeeze the bag opening 138 in the middle sleeve 136 to enclose the bag storage area 150 and secure items inside the seat portion 110 of the lounge chair towel 100. And, at least one other loop (e.g., a second loop or outer loop) of the belt strap concurrently extends at either or both lateral ends to form one or more backpack straps sized to be worn over a person's shoulders. Slack in the belt strap from the pulling forms two backpack straps.

The bag opening 138 and the bag storage area 150 are generally sized to slide over the backrest of the lounge chair. That is, with the lounge chair towel 100 deployed in a lounge configuration 102 as shown in FIG. 1., the middle portion 130 and the backrest portion 120 may slide over the backrest of the chair to securely position the lounge chair towel 100 with the lounge chair. On the back side 104 of the lounge chair towel 100, the backrest portion 120 may include a pouch 122 (e.g., netted pouch) to store pool items behind the lounge chair when the backrest portion 120 is slid onto the backrest. For example, the pouch 122 may be sewn to the back side 104 of the backrest portion 120 and include a pouch opening 124 at or proximate to a top end of the backrest portion 120 for upright storage of pool or beach items while the lounge chair towel 100 is in the lounge configuration 102.

In converting the lounge chair towel 100 from the lounge configuration 102 to a backpack configuration, the bag storage area 150 is slid off the backrest, and the seat portion 110 of the lounge chair towel 100 folds into the bag opening 138 and the bag storage area 150. Additionally, as earlier described, the bag opening 138 is closed in the process of engaging the belt strap 161-162 with the fastener rings 165-166. The backpack configuration of the lounge chair towel 100 is therefore able to securely store the seat portion 110 and other items in the bag storage area 150 formed inside the backrest portion 120 for transportation.

Figure 2:
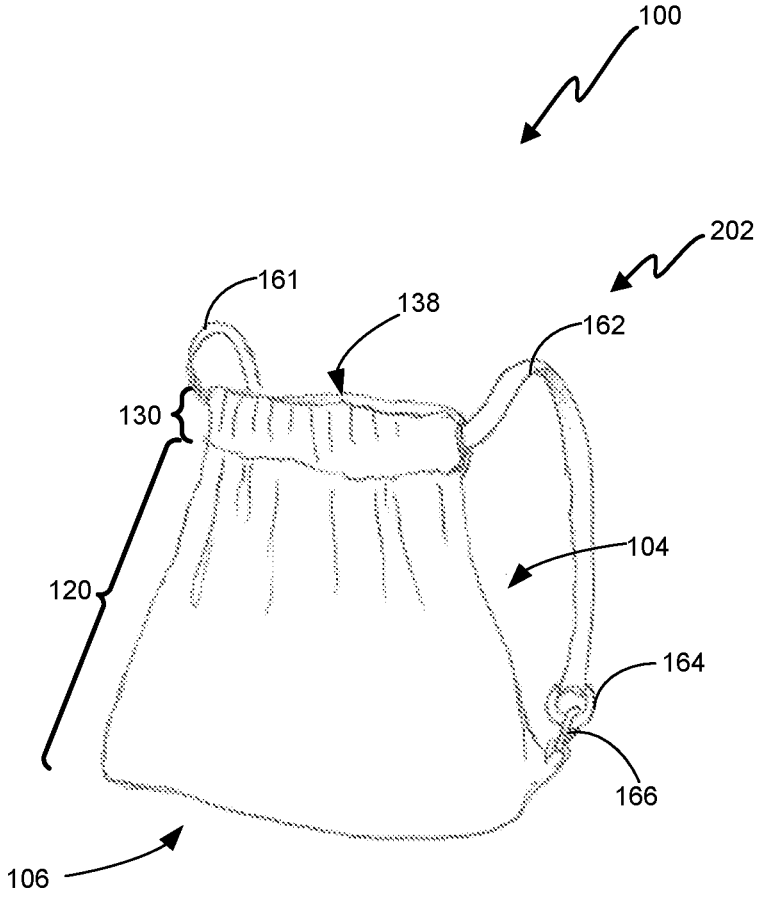
FIG. 2 illustrates the lounge chair towel in a backpack configuration in an illustrative embodiment.

FIG. 2 illustrates the lounge chair towel 100 in a backpack configuration 202 in an illustrative embodiment. In the backpack configuration 202, the fasteners 163-164 of the belt straps 161-162 engage with the fastener rings 165-166. As lateral ends of the outer loop of the belt straps 161-162 are pulled to engage with the fastener rings 165-166, the belt straps 161-162 cinch the bag opening 138 to secure the seat portion 110 and other pool/beach items/accessories stowed inside the backrest portion 120. Additionally, the belt straps 161-162 form a pair of backpack straps that can be worn to carry the lounge chair towel 100 and items.

Compared with the lounge configuration 102 in which the bag opening 138 faces down in a direction toward the ground, the bag opening 138 in the backpack configuration 202 may be flipped so that it is oriented upright to securely store the seat portion 110 and other items. Additionally, in the backpack configuration 202, the back side 104 and the pouch 122 (not shown in FIG. 2) may face the back of the wearer, while the towel material of the backrest portion 120 at the front side 106 may face outwardly.

Figure 3:
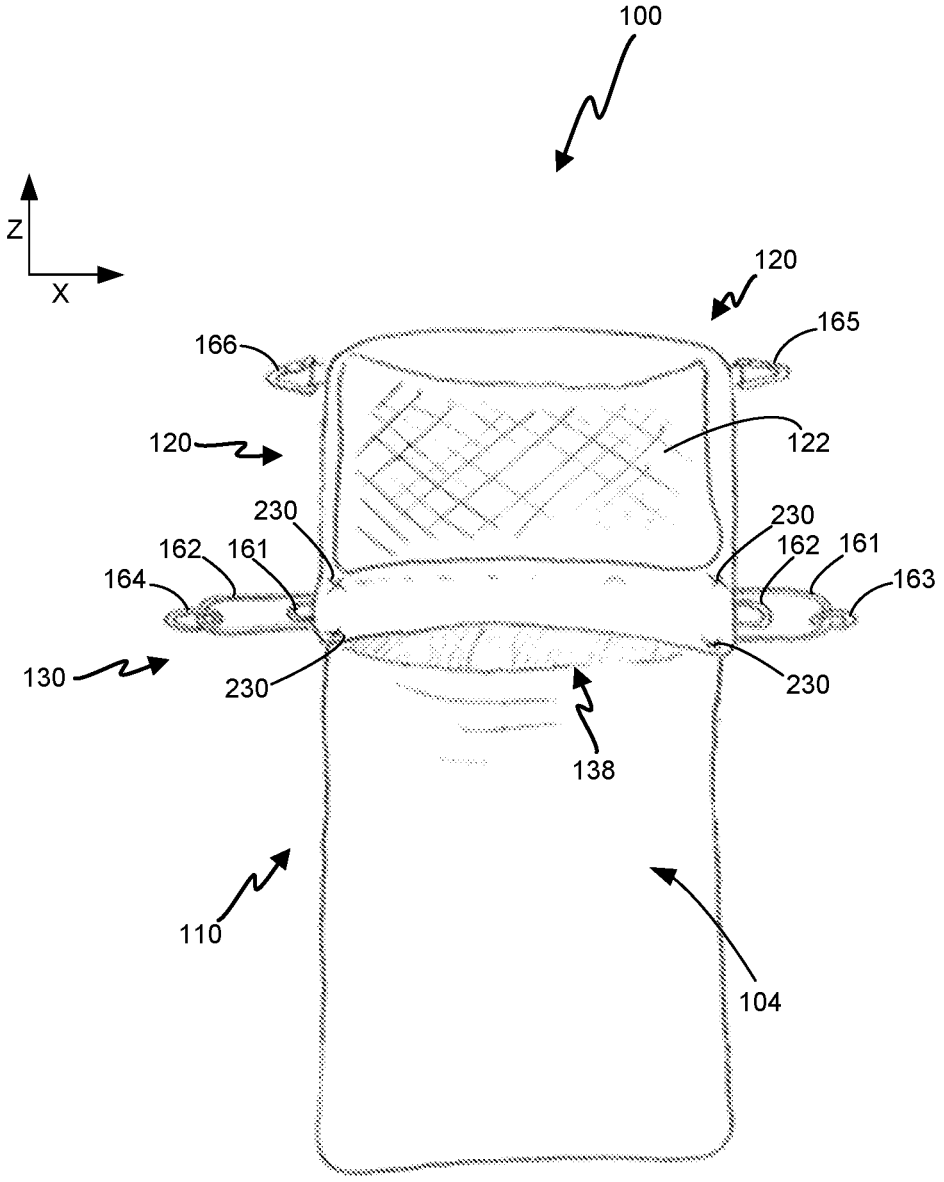
FIG. 3 is a back view of the lounge chair towel in another illustrative embodiment.

FIG. 3 is a back view of the lounge chair towel 100 in another illustrative embodiment. As shown in this example, the middle portion 130 may attach to the backrest portion 120 and the seat portion 110 via attachment points 230. For example, the attachment points 230 may be spot stitches at or near the corners of the middle portion 130. The attachment points 230 form the bag opening 138 to extend laterally (e.g., in the x-direction) along the middle portion 130 and longitudinally (e.g., in the z-direction) through the middle portion 130 to create access through the middle sleeve 136 to the bag storage area 150 (not shown in FIG. 3). In some embodiments, the bag opening 138 extends laterally along a bottom of the middle portion 130 and/or backrest portion 120. FIG. 3 also shows that the bag opening 138 may be formed at or near the base end of the middle portion 130 and/or the backrest portion 120 at the back side 104 of the lounge chair towel 100.

Figure 4:
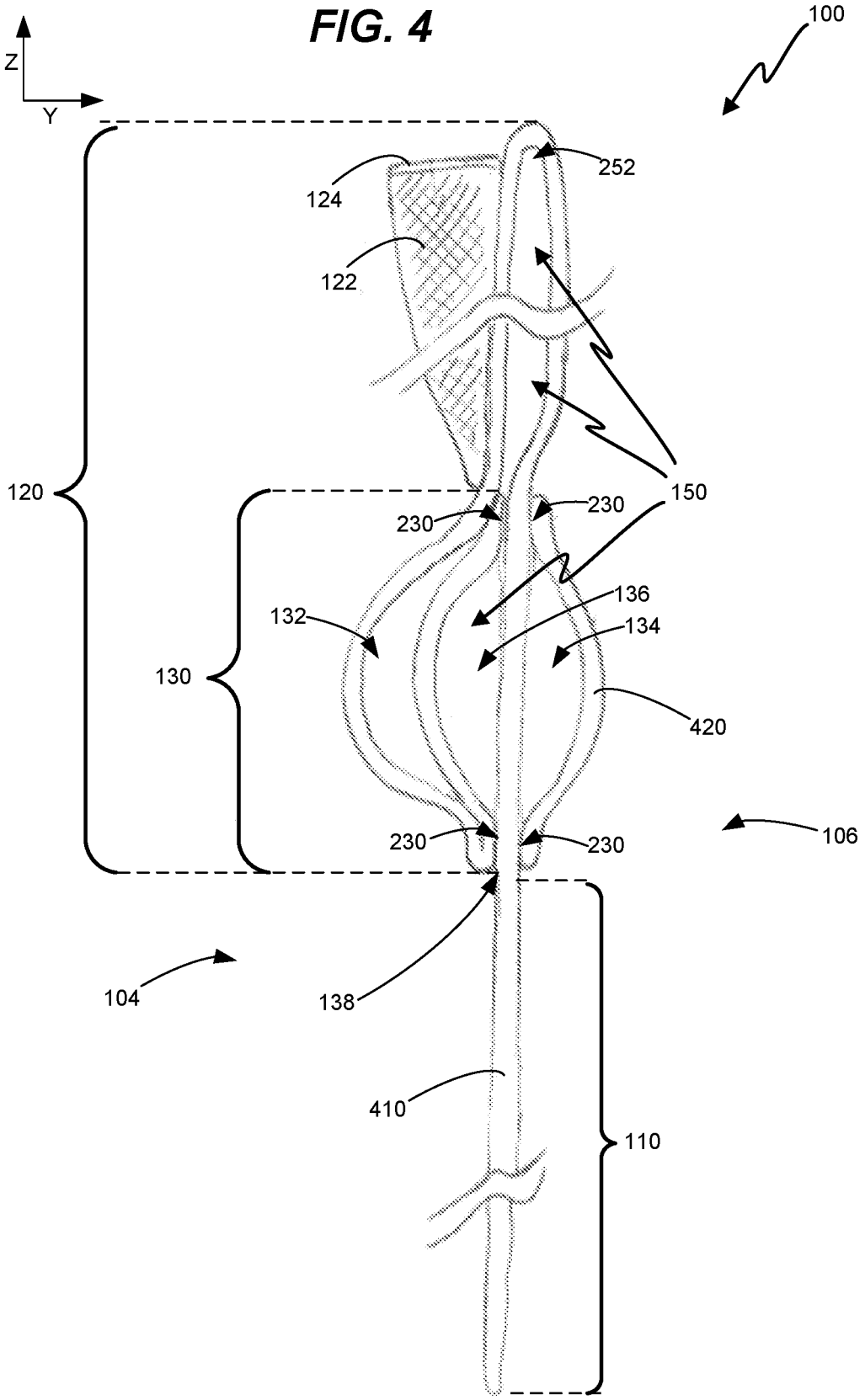
FIG. 4 is a side view of the lounge chair towel in an illustrative embodiment.

FIG. 4 is a side view of the lounge chair towel 100 in an illustrative embodiment. As shown in this example, the lounge chair towel 100 may include a continuous piece 410 of towel material for the seat portion 110, the backrest portion 120, and at least a part of the middle portion 130. That is, the continuous piece 410 may fold over itself at the top end to create a bottom 252 of the bag storage area 150 inside the backrest portion 120. The continuous piece 410 may further fold under itself at or near the bag opening 138 to create the first sleeve 132. The attachment points 230 at the back side 104 may attach the first sleeve 132 with the material of the continuous piece 410 behind it forming the middle sleeve 136. Additionally, the attachment points 230 at the back side 104 leave openings between the first sleeve 132 and the middle sleeve 136 to form the bag opening 138 and the bag storage area 150. That is, the bag opening 138 may extend longitudinally (e.g., in the z-direction) through the middle sleeve 136 and laterally between attachment points 230 on the back side 104 to create access to the bag storage area 150.

At the front side 106 of the lounge chair towel 100, the attachment points 230 may hold a secondary material piece 420 which creates the second sleeve 134. The secondary material piece 420 may include towel material or another type of material. Although not visually indicated in FIG. 4 for ease of understanding, lateral ends of the backrest portion 120, including lateral ends of the middle sleeve 136, may be closed or sewn shut to enclose the bag storage area 150 at all sides except for the bag opening 138.

As previously described, the seat portion 110 of the lounge chair towel 100 includes dimensions that substantially correspond with the seat dimensions of the lounge chair. Similarly, the backrest portion 120 of the lounge chair towel 100 includes dimensions that substantially correspond with the backrest dimensions of the lounge chair. It will thus be appreciated that the illustrations of FIG. 4 and other drawings do not illustrate components of the lounge chair towel 100 to scale so that its features are more clearly shown. For example, the seat portion 110 may include a length of approximately 65-75 inches, the backrest portion 120 may include a length of approximately 15-25 inches, and the middle portion 130 may include a length of approximately 1-7 inches. The width of the lounge chair towel 100 may include a width of approximately 27-33 inches throughout its length. Thus, with the lounge chair towel 100 fit on the chair backrest, the middle portion 130 is generally disposed at, within, or near the corner of the chair between the seat and the backrest, though some variation is possible depending on the particular dimensions of the lounge chair. Additionally, in some embodiments, the middle portion 130 comprises a lower section of the backrest portion 120, as shown in FIG. 4.

Figure 5:
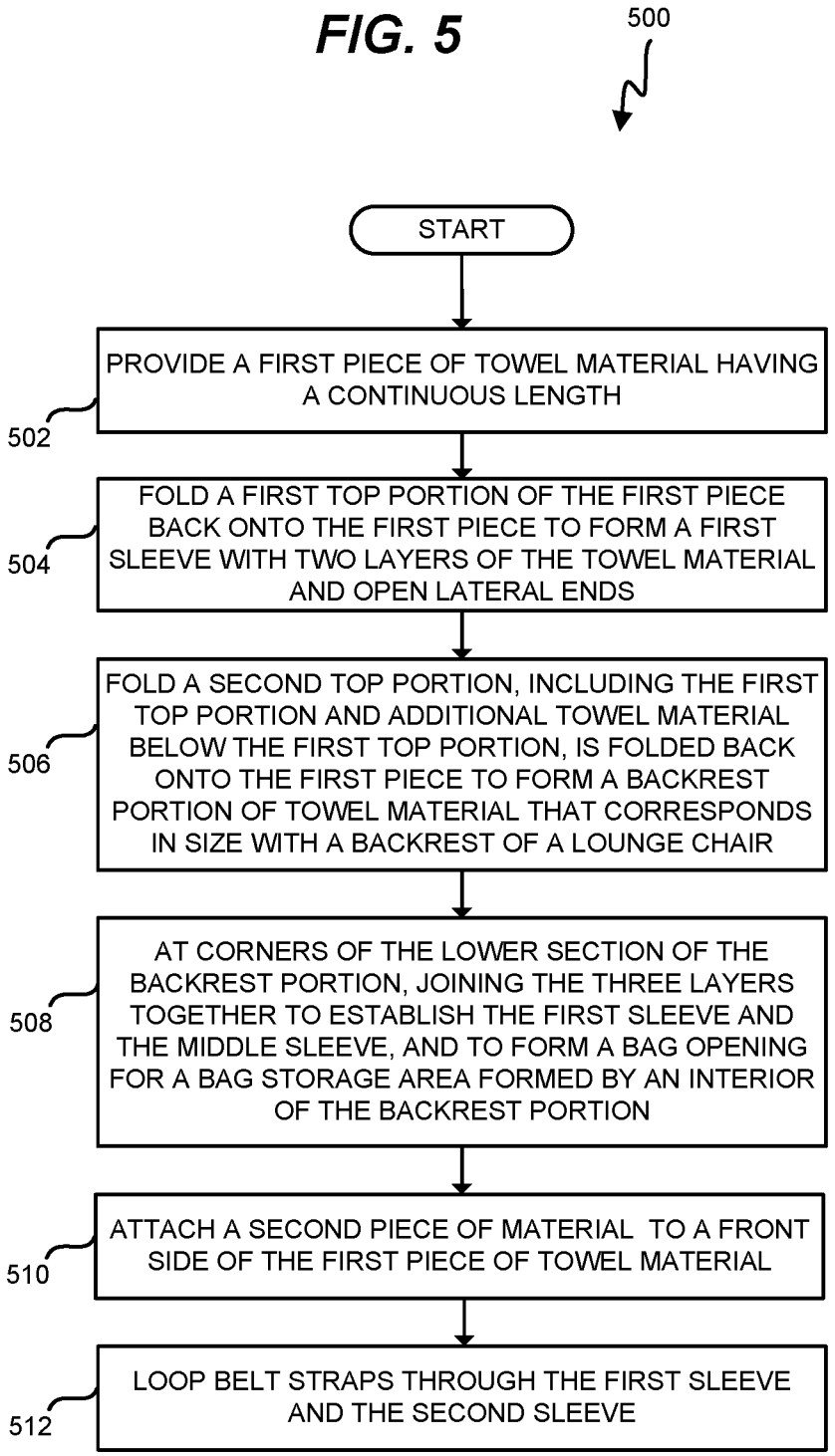
FIG. 5 is a flowchart illustrating a method of fabricating the lounge chair towel that converts into a backpack in an illustrative embodiment.

FIG. 5 is a flowchart illustrating a method 500 of fabricating the lounge chair towel 100 that converts into a backpack in an illustrative embodiment. The steps of the method 500 are described with reference to the lounge chair towel 100 of FIGS. 1-4, but those skilled in the art will appreciate that method 500 may be performed with convertible lounge towels having alternative configurations. The steps of the flowcharts described herein are not all inclusive and may include other steps not shown. The steps described herein may also be performed in an alternative order.

In step 502, a first piece of towel material having a continuous length (e.g., the continuous piece 410) is provided. In step 504, a first top portion of the first piece is folded back onto the first piece to form the first sleeve 132 with two layers of the towel material and open lateral ends. In step 506, a second top portion, including the first top portion and additional towel material below the first top portion, is folded back onto the first piece to form the backrest portion 120 of towel material that corresponds in size with a backrest of a lounge chair. A lower section of the backrest portion 120 may include three layers of the towel material that form the first sleeve 132 and the middle sleeve 136 adjacent to the first sleeve 132. In alternative embodiments, the backrest portion 120, first sleeve 132, and/or middle sleeve 136 may be formed by attaching one or more pieces of towel material together.

In step 508, at corners of the lower section of the backrest portion 120, the three layers are joined together to establish the first sleeve 132 and the middle sleeve 136, and to form the bag opening 138 for the bag storage area 150 formed by an interior of the backrest portion 120. The bag opening 138 and bag storage area 150 are sized to slide over the backrest of the lounge chair. In one embodiment, step 508 may include stitching (e.g., spot stitching at attachment points 230) corners of the middle portion 130 to form the first sleeve 132 and the middle sleeve 136 adjacently with one another.

In step 510, a second piece of material (e.g., secondary material piece 420) is attached to the front side 106 of the first piece of towel material. The second piece forms the second sleeve 134 with open lateral ends. The middle sleeve 136 is thus disposed between the first sleeve 132 and the second sleeve 134. In one embodiment, step 510 may include stitching (e.g., spot stitching at attachment points 230) corners of the middle portion 130 to form the second sleeve 134 and the middle sleeve 136 adjacently with one another.

In step 512, one or more belt straps 161-162 are looped through the first sleeve 132 and the second sleeve 134. The belt straps 161-162 are configured to tighten around the middle sleeve 136 to close the bag opening 138 by pulling the belt straps 161-162, or multiple loops of a single belt strap, in opposite directions at the first open lateral ends 142 and the second open lateral ends 144. The pulling of the belt straps 161-162 forms two backpack straps to convert the lounge chair towel 100 into the backpack.

EXAMPLES

Figure 6A:
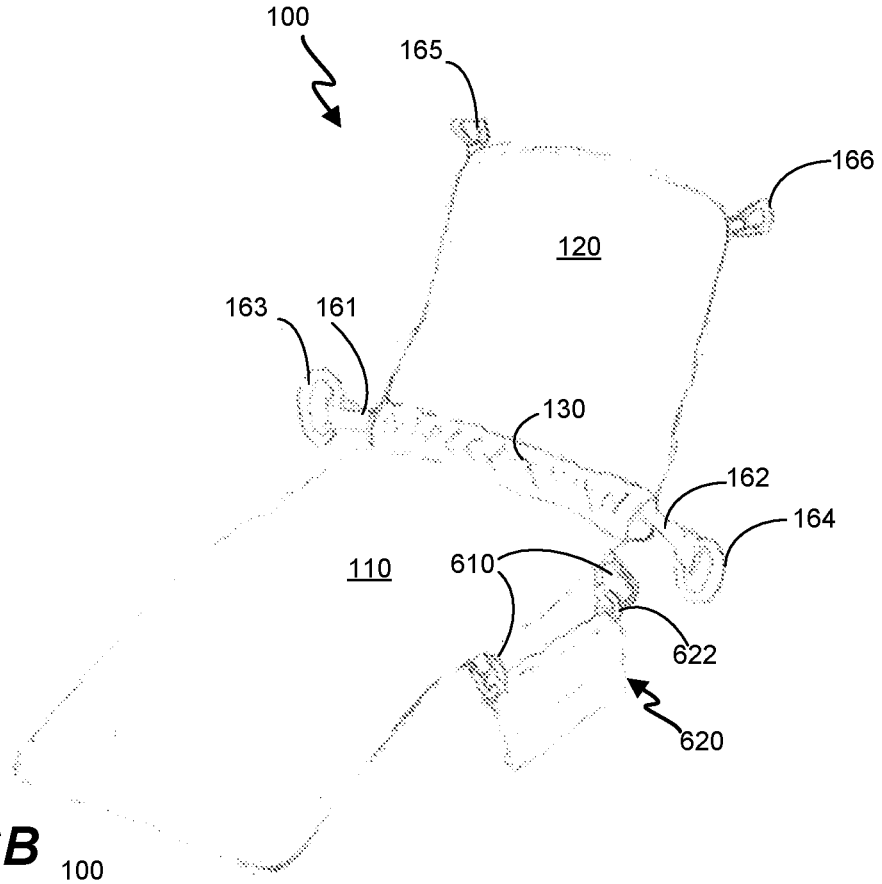
FIG. 6A is a front perspective view of the lounge chair towel in an illustrative embodiment.
Figure 6B:
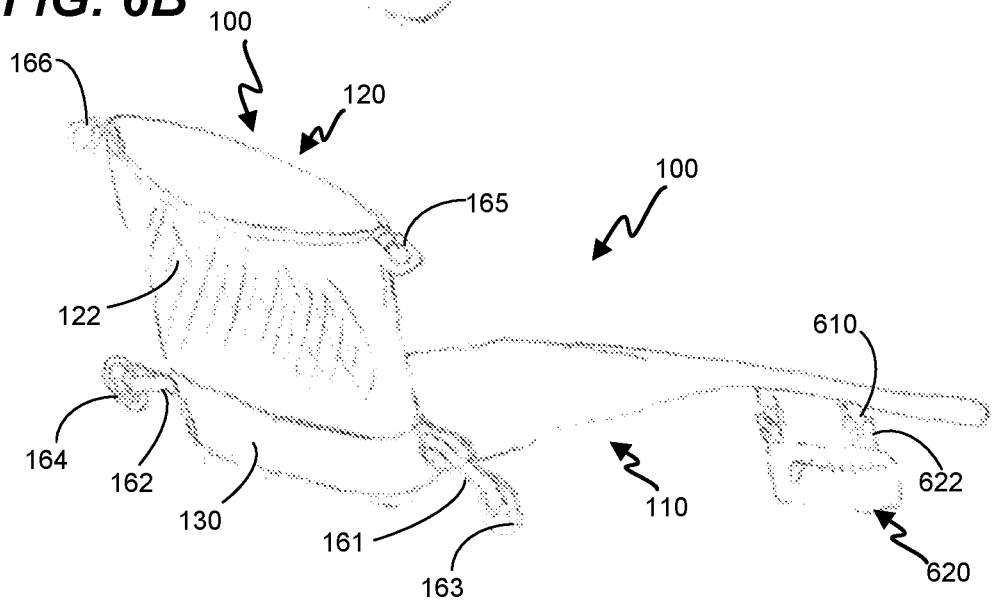
FIG. 6B is a back perspective view of the lounge chair towel in an illustrative embodiment.

FIG. 6A is a front perspective view of the lounge chair towel 100 in an illustrative embodiment. FIG. 6B is a back perspective view of the lounge chair towel 100 in an illustrative embodiment. As shown in FIG. 6A, the seat portion 110 may include one or more bag clips 610 attached at its side for attaching an accessory bag 620. The bag clips 610 may releasably engage with the accessory bag 620 via one or more attachment rings 622 on the accessory bag 620. The bag clips 610 and/or attachment rings 622 may include any suitable fastener combination including metal or plastic clasps, rings, clips, buckles, snaps, hooks, etc. Alternatively or additionally, accessory bag 620 may be stitched to one of the sides of the seat portion 110, and/or the seat portion 110 may include one or more straps on its side to suspend the accessory bag 620 off the side of the lounge chair and above the ground. For transportation, the seat portion 110 (along with its attached bags and/or unattached bags/items) may be folded/tucked into the bag opening 138 and stuffed into the backrest portion 120 and worn as a backpack.

Although specific embodiments were described herein, the scope of the invention is not limited to those specific embodiments. Rather, the scope is defined by the following claims and any equivalents thereof.

What is claimed is:

1. A lounge chair towel that converts into a backpack, the lounge chair towel comprising:

a seat portion of towel material that corresponds with a seat of a lounge chair;

a backrest portion of towel material that corresponds with a backrest of the lounge chair; and a middle portion of material between the seat portion and the backrest portion, wherein the middle portion comprises:

a first sleeve extending laterally along a width of the lounge chair towel and including first open lateral ends;

a second sleeve extending laterally along the width of the lounge chair towel and including second open lateral ends;

a bag opening for a bag storage area formed by an interior of the backrest portion, wherein the bag opening and the bag storage area are sized to slide over the backrest of the lounge chair; and one or more belt straps looped through the first sleeve and the second sleeve, wherein the one or more belt straps are configured to close the bag opening by pulling the one or more belt straps in opposite directions at the first open lateral ends and the second open lateral ends to form two backpack straps to convert the lounge chair towel into the backpack.

2. The lounge chair towel of claim 1 wherein:

the bag opening extends laterally along the middle portion.

3. The lounge chair towel of claim 2 wherein:

the bag opening extends laterally along a bottom of the middle portion.

4. The lounge chair towel of claim 1 wherein:

wherein the bag opening and the bag storage area are sized to slide over the backrest of the lounge chair in a lounge configuration, and sized to receive the seat portion and carrying items for transport in a backpack configuration.

5. The lounge chair towel of claim 1 wherein:

the one or more belt straps include fasteners to detachably engage fastener rings attached at or near a top end of the backrest portion.

6. The lounge chair towel of claim 5 wherein:

as the one or more belt straps are pulled to engage the fasteners with the fastener rings, the one or more belt straps squeeze the bag opening to enclose the bag storage area and secure items inside the seat portion for transportation.

7. The lounge chair towel of claim 1 wherein:

the backrest portion includes a pouch to store items behind the lounge chair when the backrest portion is slid onto the backrest of the lounge chair.

8. The lounge chair towel of claim 1 wherein:

the seat portion includes one or more bag clips attached at its side for attaching an accessory bag.

9. The lounge chair towel of claim 1 further comprising:

a third sleeve disposed in the middle portion with the first sleeve and the second sleeve, wherein a continuous piece of towel material forms the seat portion, the backrest portion, the first sleeve, and the third sleeve, and wherein the second sleeve is stitched to one of a front side of the lounge chair towel and a back side of the lounge chair towel.

10. A method of fabricating a lounge chair towel that converts into a backpack, the method comprising:

providing a first piece of towel material having a continuous length;

folding a first top portion of the first piece back onto the first piece to form a first sleeve with two layers of the towel material and first open lateral ends;

folding a second top portion, including the first top portion and additional towel material below the first top portion, back onto the first piece to form a backrest portion of towel material that corresponds in size with a backrest of a lounge chair, wherein a lower section of the backrest portion includes three layers of the towel material that form the first sleeve and another sleeve adjacent to the first sleeve;

at corners of the lower section of the backrest portion, joining the three layers together to establish the first sleeve and the another sleeve, and to form a bag opening for a bag storage area formed by an interior of the backrest portion, wherein the bag opening and bag storage area are sized to slide over the backrest of the lounge chair;

attaching a second piece of material that forms a second sleeve with second open lateral ends; and looping one or more belt straps through the first sleeve and the second sleeve, wherein the one or more belt straps are configured to close the bag opening by pulling the belt strap in opposite directions at the first open lateral ends and the second open lateral ends to form two backpack straps to convert the lounge chair towel into the backpack.

11. The method of claim 10 wherein:

the bag opening extends laterally along the middle portion.

12. The method of claim 11 wherein:

the bag opening extends laterally along a bottom the middle portion.

13. The method of claim 10 wherein:

wherein the bag opening and the bag storage area are sized to slide over the backrest of the lounge chair in a lounge configuration, and sized to receive a seat portion of the first piece of towel material and carrying items for transport in a backpack configuration.

14. The method of claim 10 further comprising:

providing fasteners on the belt strap to detachably engage fastener rings attached at or near a top end of the backrest portion.

15. The method of claim 14 wherein:

as the one or more belt straps are pulled to engage the fasteners with the fastener rings, the one or more belt straps squeeze the bag opening to enclose the bag storage area and secure items inside a seat portion of the first piece for transportation.

16. The method of claim 10 further comprising:

attaching a pouch to the backrest portion to store items behind the lounge chair when the backrest portion is slid onto the backrest of the lounge chair.

17. The method of claim 10 further comprising:

attaching one or more bag clips to side of the seat portion for attaching an accessory bag.

18. The method of claim 10 wherein:

the first piece of towel material forms a seat portion, the backrest portion, the first sleeve, and the another sleeve.

19. The method of claim 10 further comprising:

attaching the second sleeve to one of a front side of the first piece of towel material and a back side of the first piece of towel material.

20. The method of claim 10 further comprising:

stitching corners of the middle portion to form the first sleeve and the another sleeve adjacently.

* * * * *